US005088706A

United States Patent [19]

Jackson

[11] Patent Number: 5,088,706

[45] Date of Patent: Feb. 18, 1992

[54] SPINAL SURGERY TABLE

[76] Inventor: Roger P. Jackson, 4706 W. 86th St., Prairie Village, Kans. 66207

[21] Appl. No.: 575,138

[22] Filed: Aug. 30, 1990

[51] Int. Cl.[5] ..... A61G 13/00

[52] U.S. Cl. ..... 269/323

[58] Field of Search ..... 5/61; 378/208, 209; 128/75, 68, 71, 72, 73, 74, 84 R; 269/322, 323, 328; 108/6

[56] References Cited

U.S. PATENT DOCUMENTS

| | | | |
|---|---|---|---|
| 2,103,693 | 12/1937 | Pohl | 269/323 |
| 2,188,592 | 1/1940 | Cunningham | 5/61 |
| 2,452,816 | 11/1948 | Wagner | 269/328 |
| 3,226,734 | 1/1966 | Coventon | 269/328 |
| 3,814,414 | 6/1974 | Chapa | 269/323 |
| 3,827,089 | 8/1974 | Grow | 5/61 |
| 3,873,081 | 3/1975 | Smith | 269/328 |
| 3,949,983 | 4/1976 | Tommasino | 269/328 |
| 4,244,358 | 1/1981 | Pyers | 5/61 |
| 4,866,796 | 9/1989 | Robinson et al. . | |
| 4,937,901 | 7/1990 | Brennan | 5/61 |

FOREIGN PATENT DOCUMENTS

| | | | |
|---|---|---|---|
| 2523433 | 3/1982 | France | 269/323 |

OTHER PUBLICATIONS

J. E. S. Relton et al.; "An Operation Frame for Spinal Fusion"; Jo. of Bone and Joint Surgery, vol. 49B, No. 2, May 1967, pp. 327-332.

W. H. Mouradian et al.; "A Frame for Spinal Surgery . . . Traction is Applied"; Jo. of Bone and Joint Surgery, vol. 59, #8, Dec. 1977, pp. 1098-1099.

T. R. Trammell et al.; "Controlled Mobilization of Patients . . . Foster Frame"; Orthopedics, vol. 8, No. 12, Dec. 1985, pp. 1489-1491.

C. D. Ray; "New Kneeling Attachment and . . . Spinal Surgery"; Neurosurgery, vol. 20, No. 2, 1987, pp. 266-269.

R. A. Callahan et al.; "Positioning Techniques in Spinal Surgery"; Clinical Orthopaedics & Related Research, #154, Jan.-Feb. 1981, pp. 22-26.

*Primary Examiner*—Robert C. Watson

*Attorney, Agent, or Firm*—Litman, McMahon & Brown

[57] ABSTRACT

An apparatus for supporting a patient in a prone position during surgery which allows the surgeon to adjust the relative positioning of the patient during surgery. The apparatus generally comprises a patient support structure rotatably mounted on an expandable framework which is connected to an elongate base by a pair of hydraulic lifts. The patient may initially be positioned on the table in a supine position and then rotated so as to be supported in a prone position by the patient support structure with the patient's abdomen pendulous and free. The hydraulic lifts are positioned at the ends of the base and allow one end of the expandable framework and the patient support structure to be raised or lowered with respect to the other end. The patient support structure may be rotated so as to angle the patient's back towards or away from the surgeon.

21 Claims, 4 Drawing Sheets

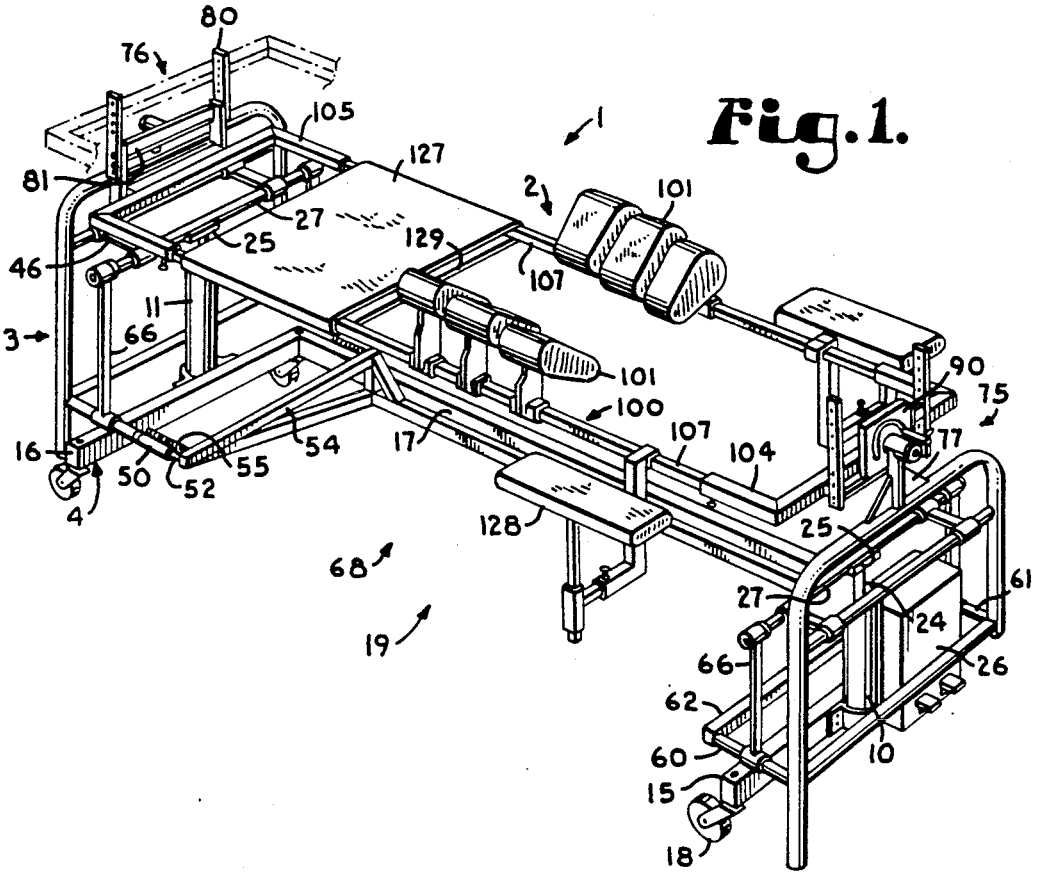
Fig. 1.
Fig. 2.
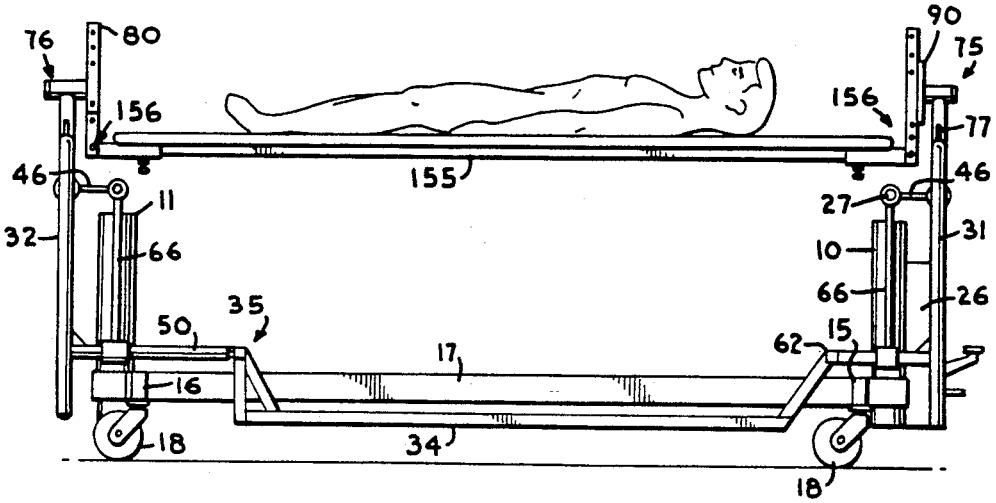

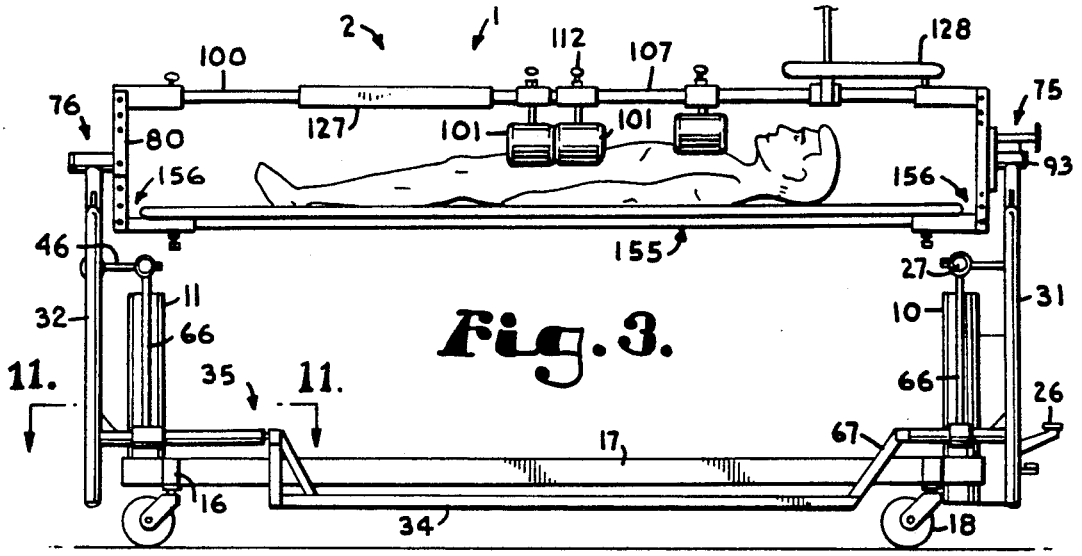
Fig. 3.
Fig. 4.
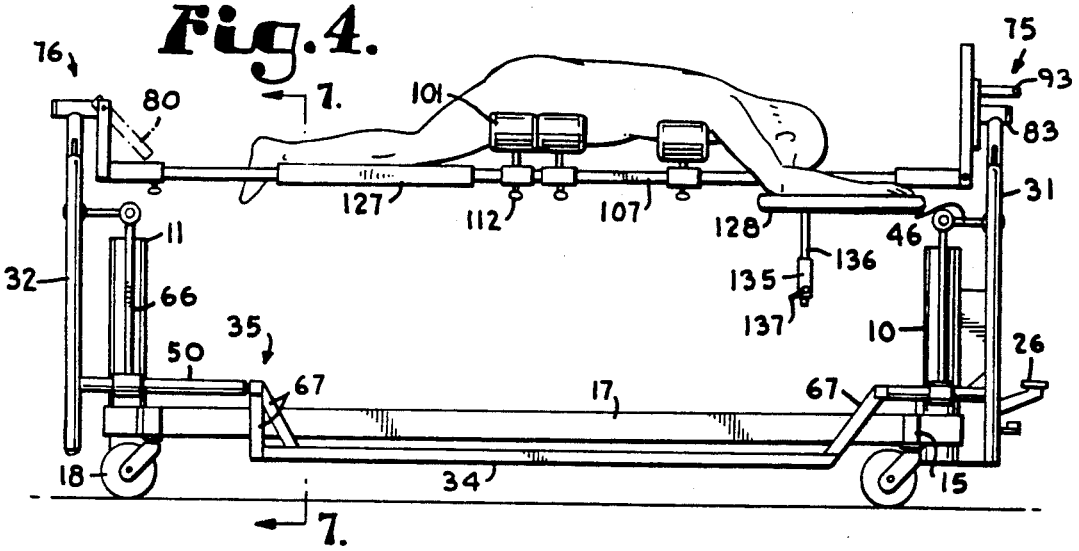
Fig. 5.
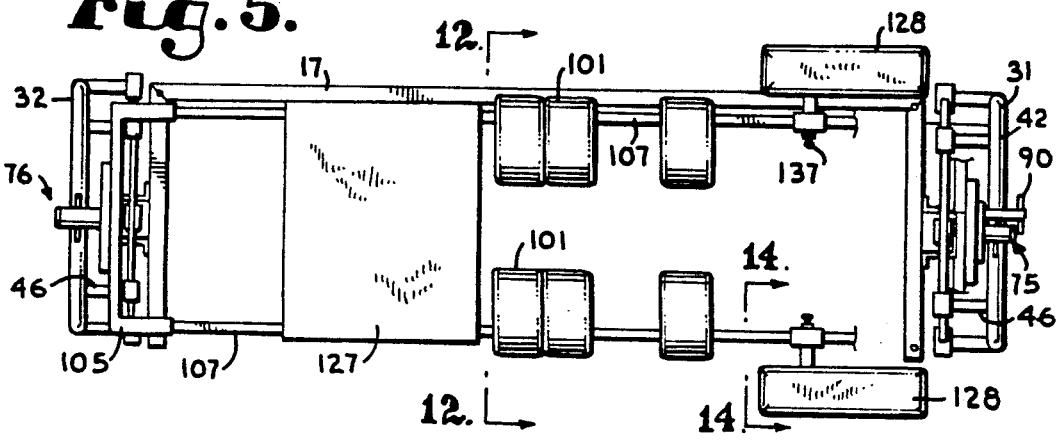

Fig. 10.
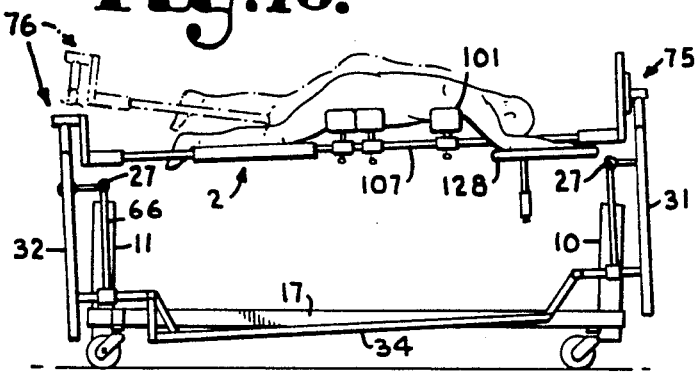
Fig. 11.
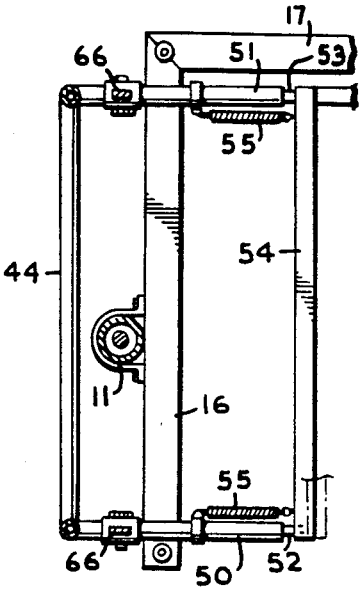
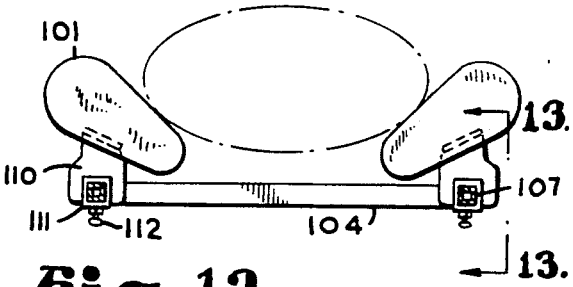
Fig. 12.
Fig. 13.
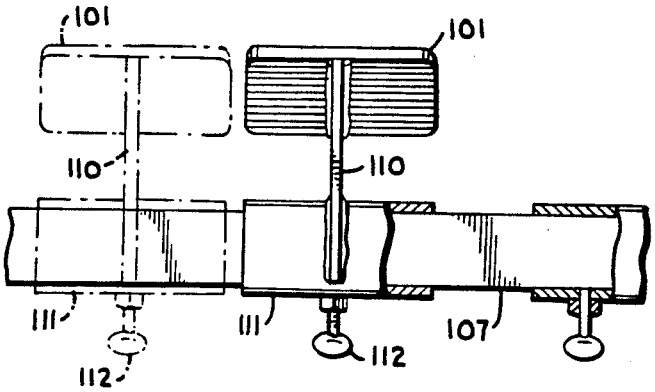
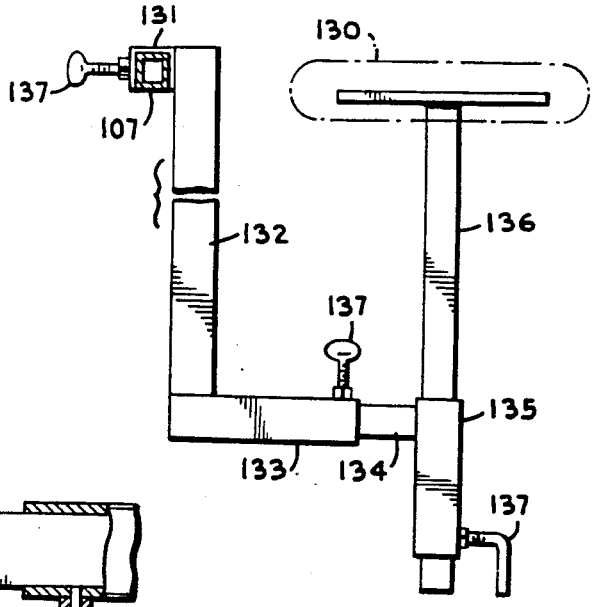
Fig. 14.

SPINAL SURGERY TABLE

BACKGROUND OF THE INVENTION

The apparatus of the present invention generally relates to a structure for use in maintaining a patient in an appropriate prone position during back surgery and in particular to such a structure which allows the surgeon to selectively position the patient with respect to the surgeon so as to provide the surgeon with the most convenient access to the site of surgery and manipulation of the patient during surgery, especially for rotation of the patient.

Positioning of the patient is an important consideration in back surgery. In general a patient undergoing back surgery must be positioned in a prone position to provide the surgeon adequate access to the surgical site. Initially, patients were simply placed on their stomachs on the operating table or on a mattress or board positioned between the operating table and the patient. Although this technique provided access to the back, it also suffered drawbacks.

Back surgery is often accompanied by substantial blood loss. It has been found that placing a patient on their stomach on a table or mattress increases the intra-abdominal pressure which tends to increase the blood loss. Blood loss may be reduced by supporting the patient in a prone position with the abdomen pendulous and free. With this principal in mind, structures were devised which would support a patient in such a prone position.

Typically, a patient is supported in a prone position by two sets of opposed pads arranged in V-shaped pairs and connected by a framework. One pair of opposed pads supports the lateral aspects of the upper thoracic cage and the other pair supports the antero-lateral aspects of the pelvic girdle thereby allowing the abdomen to hang pendulous and free.

Although such support structures help reduce blood loss, they limit the ability of the surgeon to adjust the position of the patient during surgery. During surgery, it is desirable to be able to raise and lower the patient, to raise one end of the patient relative to the other, and to tilt the patient's back towards or away from the surgeon along an axis running generally through the spine, that is to rotate the patient from side to side. The existing support structures which support a patient in a prone position with the abdomen pendulous and free are not adapted to allow such manipulation by the surgeon.

The existing support structures also present serious shortcomings with regards to the act of placing a patient on the support structure. Generally, the patient is brought into the operating room in a supine position on a gurney. The surgical team manually lifts the patient off the gurney and then turns the patient over and onto the support pads of the support structure. This procedure is difficult and potentially harmful to the patient, especially if the patient has a broken back.

Existing support structures also provide limited access to the surgical site for other surgical equipment, such as X-ray equipment. Many previous back surgery support structures are simply positioned on a standard operating table and do not provide access beneath the support structure for a C-arm type X-ray apparatus, that is, the support structures are in the way of the X-rays generated by the X-ray apparatus.

SUMMARY OF THE INVENTION

The present invention provides an apparatus for use in supporting a patient during surgery in a prone position with the abdomen pendulous and free and which allows the surgeon to adjust the relative positioning of the patient with respect to the surgeon. The apparatus generally comprises a patient support structure rotatably mountable on an expandable framework which is in turn connected to a elongate base by a first and a second hydraulic lift.

The elongate base, having a head end and a foot end, has four wheels secured to the underside thereof which maintain the base in spaced and parallel relation with the floor. The first and second hydraulic lifts are secured in perpendicular and vertical alignment to the head end and foot end of the elongate base respectively. Each hydraulic lift includes a lift arm extending vertically therefrom which is selectively positionable at a plurality of positions between a high and a low position. The positioning of each lift arm is independently controlled.

The expandable framework generally comprises a first and a second end piece maintained in parallel and spaced alignment and an expandable crossmember extending therebetween. The first and second end pieces are pivotally secured to the lift arms of the first and second hydraulic lifts respectively so that, as the lift arm of one of the hydraulic lifts is advanced independently of the other, the expandable crossmember expands or contracts to compensate for the change in distance between the first and second en pieces which are maintained in parallel relation.

First and second rotatable mounts are secured to the first and second end pieces respectively by vertical support members extending vertically away from the end pieces. Each of the rotatable mounts includes a pair of elongate receiving arms maintained in parallel and spaced relation by a cross piece extending therebetween. A pivot pin is centrally and securely mounted on each cross piece and rotatably received within a journal which is securely mounted on an upper end of each vertical support member. The journals are secured to the vertical support members in axial alignment so that the pivot pins rotate about the sam axis. Each pair of elongate receiving arms and respective cross-piece are rotatably mounted in said journals so as to be inwardly directed. Each pair of elongate receiving arms includes a plurality of linearly aligned apertures.

The patient support structure generally comprises a rectangular frame having support pads adjustably mounted thereon. The rectangular frame includes a first and a second mountable end maintained in spaced and parallel relation and a pair of opposed legs extending therebetween in spaced and parallel relation. Each mountable end includes a pair of opposingly directed spring loaded pins selectively receivable within a pair of the linearly aligned apertures in the elongate receiving arms of the rotatable mounts.

The support pads comprise three pairs of pads slidably mounted on the opposed legs of the rectangular frame. Each pad is angled inward and downward so that opposed pairs form a V-shaped support surface. The pads are positionable under a patient so that the patient is supported by the pads in a prone position with the patient's abdomen pendulous and free. A fabric sleeve extends around a section of the opposed legs of said rectangular frame between the support pads and the second mountable end and provides support for the legs of a patient supported in a prone position by the support pads. A pair of armrests are slidably mountable on the opposed legs of the rectangular frame between the support pads and the first mountable end. The rectangular frame is removably securable to the rotatable mounts by selectively positioning the opposingly directed spring loaded pins of the first and second mountable ends in aligned apertures in the elongate receiving arms. When secured to the rotatable mounts, the rectangular frame is rotatable about the axis extending through the aligned pivot pins. That axis generally extends along the spine of a patient supported in a prone position on the support pads. The frame is connected to the expandable framework such that as either end of the expandable framework is raised or lowered the corresponding end of the frame is raised or lowered. The frame includes a plurality of expansion joints which allow the frame to expand or contract as either end of the frame is raised or lowered so as to compensate for changes in distance between the rotatable mounts.

A planar support surface having dimensions similar to those of the rectangular frame is also removably securable to the rotatable mounts by opposingly directed pins. A patient is initially positioned in a supine position on the planar support surface. The planar support surface is then secured to the rotatable mounts with the patient maintained in a supine position. The patient support structure is then positioned over the patient. The support pads are then positioned over the patient in such a position that the pads will support the patient in a prone position with the patient's abdomen pendulous and free when the support structure is turned over. The patient support structure is secured to the rotatable mounts and the support structure, the planar support surface, and the patient are then rotated 180 degrees so that the patient is supported by the support pads in the prone position. The planar support surface is then removed from the rotatable mounts.

Once the patient is supported in the prone position by the patient support structure the surgeon may raise or lower one end of the patient with respect to the other using the hydraulic lifts, or the surgeon may rotate the patient support structure about the rotatable mounts so as to angle or rotate the patient's back towards or away from the surgeon positioned laterally with respect to the patient.

OBJECTS AND ADVANTAGES OF THE INVENTION

Therefore, the objects of the present invention are: to provide an apparatus for supporting a patient in a prone position during surgery; to provide such an apparatus which maintain's the abdomen of a patient supported thereon pendulous and free; to provide such an apparatus which allows one end of the patient to be raised or lowered with respect to the other; to provide such an apparatus which allows the patient to be rotated about an axis running generally through the patient's spine; to provide such an apparatus which allows the patient to initially be secured to the table in a supine position and then rotated into the prone position while secured to the apparatus; to provide such an apparatus which provides surgical personnel minimal obstructions as to patient access; to provide such an apparatus that is particularly well adapted for use with X13 ray and related medical equipment so as to provide substantial intra-operative X-ray control; to provide such an apparatus which is portable; to provide such an apparatus which is relatively inexpensive to manufacture, easy to use and particularly well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a surgery apparatus of the present invention having a head end and a foot end including a patient support structure removably secured thereto.

FIG. 2 is a side elevational view of the apparatus including a planar support surface removably secured thereto and having a patient supported in a supine position thereon.

FIG. 3 is a side elevational view of the apparatus having a patient support structure and planar support surface removably secured thereto and having a patient supported therebetween.

FIG. 4 is a side elevational view of the apparatus showing a patient supported in a prone position on the patient support structure subsequent to turning the patient from the supine to the prone position.

FIG. 5 is a top plan view of the apparatus having the patient support structure removably secured thereto.

FIG. 10 is a side elevational view of the apparatus of the present invention having a patient supported in a prone position on the patient support structure showing the variation of the positioning of the head end with respect to the foot end.

FIG. 11 is an enlarged and fragmentary cross-sectional view of the apparatus, taken along line 11—11 of FIG. 3, showing an expansion mechanism for the apparatus.

FIG. 12 is an enlarged cross-sectional view of the patient support structure, taken along line 12—12 of FIG. 5 showing in phantom lines the relative positioning of a patient thereon.

FIG. 13 is an enlarged and fragmentary cross-sectional view of the patient support structure, taken along line 13—13 of FIG. 12, showing variation in the position of a support pad on the patient support structure in solid and phantom lines.

FIG. 14 is an enlarged and fragmentary cross-sectional view of the apparatus, taken along line 14—14 of FIG. 5, showing an armrest secured to the patient support structure.

DETAILED DESCRIPTION OF THE INVENTION

Figure 6:
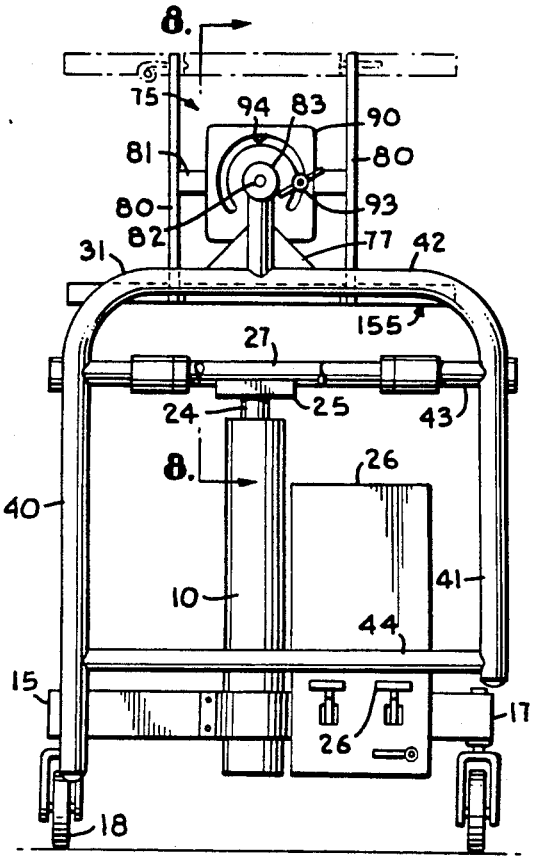
FIG. 6 is an enlarged, head end elevational view of the apparatus.
Figure 7:
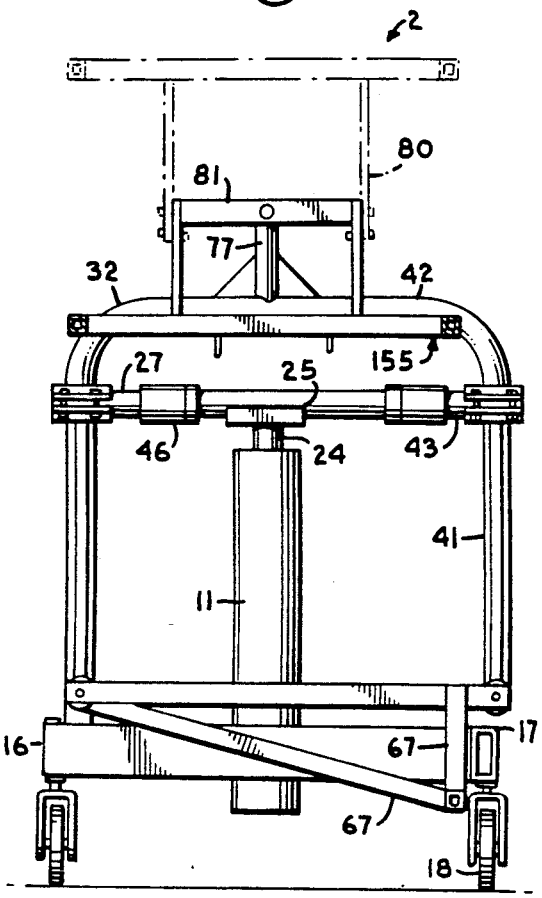
FIG. 7 is a an enlarged cross-sectional view of the apparatus, taken along line 7—7 of FIG. 4.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, reference numeral 1 generally represents a spinal surgery table for supporting a patient in a prone position during surgery. The table 1 generally comprises a patient support structure 2 rotatably mountable on an expandable framework 3 which is in turn connected to an elongate base 4 by first and second hydraulic lifts 10 and 11.

The elongate base 4 is generally U-shaped, having first and second side arms 15 and 16 maintained in spaced and parallel relation by an elongate crossbar 17. Four wheels 18 are secured to the underside of the elongate base 4 and support the base 4 in spaced relation above the surface upon which the base 4 is positioned. The side of the base 4 opposite of the crossbar 17 forms an open side 19. Although the U-shaped base 4 is particularly well adapted for providing access beneath the patient support structure 2 for other surgical equipment, it is foreseen that the base could be made of various configurations such as H-shaped or completely rectangular.

The first and second hydraulic lifts 10 and 11 are secured to the first and second side arms 15 and 16 respectively along a midpoint thereof. The hydraulic lifts 10 and 11 extend vertically and perpendicularly away from respective sidearms 15 and 16. Each hydraulic lift 10 and 11 includes a lift arm 24 extending vertically away from the lifts 10 and 11 and having a horizontal support member 25 secured to the end thereof. Each horizontal support member 25 is selectively and independently positionable between a high point and a low point by a respective lift arm 24. The positioning of the horizontal support members 25 is controlled by a hydraulic control unit 26. The control unit 26 allows an operator to position either of the horizontal support members 25 between respective high points and low points independent of the other.

A horizontal extension member 27 is secured to and aligned with the horizontal support member 25 of each hydraulic lift 10 and 11. The horizontal extension members 27 extend above and along the first and second side arm 15 and 16 of the base 4 in spaced relation. Positioning of the horizontal support members 25 with the control unit 26 similarly positions the horizontal extension members 27.

The expandable framework 3 generally includes a first end piece 31 and a second end piece 32 maintained in parallel and spaced alignment; a crossmember 34 extending therebetween; and an expansion means, such as the illustrated expansion mechanism, 35 allowing the framework to expand and contract. Each of the end pieces 31 and 32 include a first and a second vertical member 40 and 41 connected by first, second and third horizontal members 42, 43 and 44. The end pieces 31 and 32 are generally the same width as the first and second side arms 15 and 16 of the base 4.

The first and second end pieces 31 and 32 are secured to the horizontal extension members 27 of the first and second hydraulic lifts 10 and 11 respectively by a pair of horizontal connecting members 46. The horizontal connecting members 46 are pivotally connected to the horizontal extension members 27 and extend from the horizontal extension members 27 to the second horizontal members 43 of the end pieces 31 and 32 to which the horizontal connecting members 46 are securely connected. The first and second end pieces 31 and 32 are positioned by the horizontal connecting members beyond the first and second hydraulic lifts 10 and 11.

The expansion mechanism 35 includes a first and a second expansion sleeve 50 and 51 extending perpendicularly away from the first and second vertical members 40 and 41 of the second end piece 32 towards the first end piece 31. Expansion pins 52 and 53 secured to an expansion cross member 54 are slidingly received within expansion sleeves 50 and 51. The expansion cross member 54 generally extends parallel to the third horizontal member 44 of the second end piece 32 and may be slidingly advanced towards and away from the first end piece 31. A pair of springs 55 secured to the expansion cross member 54 and the first and second expansion sleeves 50 and 51 restrain the expansion cross member 54 from advancing towards the first end piece 31.

Similarly a first and a second cylindrical member 60 and 61 extend perpendicularly away from the first and second vertical members 40 and 41 of the first end piece 31 towards the second end piece 32. A secured cross member 62 is securely attached to the first and second cylindrical members 60 and 61 so as to extend generally parallel to the third horizontal member of the first end piece 31. A pair of vertical connecting members 66 extends from the horizontal extension members 27 to the first and second expansion sleeves 50 and 51 and to the first and second cylindrical members 60 and 61. The vertical connecting members 66 are pivotally secured to the horizontal extension members 27 and securely attached to the first and second expansion sleeves 50 and 51 and the first and second cylindrical members 60 and 61. The cross member 34 is secured to the expansion cross member 54 and the secured cross member 62 by attachment members 67, as shown in FIG. 1, such that cross member 34 extends therebetween in closely spaced relation to the crossbar 17. The cross member 34, the expansion cross member 54 and the secured cross member 62 define or frame an open region or area 68 covering a significant portion of the area framed by the base 4 which is unobstructed by the framework 3 from the floor upward. The open area 68 provides unobstructed access beneath the patient support structure 2 for other surgical equipment.

A first rotatable mount 75 and a second rotatable mount 76 are secured to the first and second end pieces 31 and 32 respectively by a vertical support member 77 medially positioned on the first horizontal member 42 of each end piece 31 and 32 and extending vertically therefrom. Each rotatable mount 75 and 76 comprises a pair of elongate receiving arms 80 maintained in parallel and spaced relation by a cross piece 81 extending therebetween. A pivot pin 82 is centrally and securely mounted on each cross piece 81 and rotatably received within a journal 83 that is securely mounted to an upper end of each vertical support member 77. Bushings 85 within the journals 83 have slidable but abrasive surfaces or the like to produce a frictional engagement with the pivot pins 82 so as to produce a controlled friction to allow the pivot pins 82 to rotate within the journals 83 when a medical practitioner applies manual rotative pressure to the patient support structure 2, but that maintains the patient support structure in a selected position when no pressure is applied thereto by a practitioner. The journals 83 are secured to the vertical support members 77 in axial alignment, so that the pivot pins 82 rotate about the same axis. Each pair of the elongate receiving arms 80 and a respective cross piece 81 are rotatably mounted in the journals 83 so as to be inwardly directed.

Each pair of elongate receiving arms 80 includes a plurality of linearly aligned apertures 84 extending on either side of the cross pieces 81. An upper portion of each elongate receiving arm 80 of the second rotatable mount 75 is pivotally connected to the cross piece 81 and is selectively positionable as shown in FIG. 4 at an angle to the remainder or extended to be co-linear with the remainder, as shown in FIG. 3.

The first rotatable mount 75 includes position locking means, such as locking mechanism 90, comprising a threaded pin 91, a plate 92 and a locking nut 93. The threaded pin 91 is secured to and extends perpendicularly and horizontally away from the cross piece 81 of the first rotatable mount 75 in a direction away from the second rotatable mount 76. The plate 92 is secured to and extends around the end of the journal 83 adjacent the cross piece 81 so as to extend generally perpendicular to the journal 83. The plate 92 includes a circular channel 94 which extends substantially, preferably at least 270 degrees, around the pivot pin 82 a distance equal to the distance from the pivot pin 82 to the threaded pin 91. The threaded pin 91 extends through the channel 94 and the locking nut 93 is threaded onto the threaded pin 91. As the elongate receiving arms 80 and the cross piece 81 of the first rotatable mount 75 are rotated about an axis extending through the pivot pin 82, the locking nut 93 may be tightened so as to engage the plate 92 and prevent further rotation of the cross piece 81 and the receiving arms 80 and lock the rotatable mount 75 in position.

The patient support structure 2 generally comprises a rectangular frame 100 having three pairs of support pads 101 adjustably mounted thereto. The rectangular frame 100 includes a first mountable end 104 and a second mountable end 105 maintained in spaced relation by a pair of opposed legs 106 extending therebetween in spaced and parallel relation. The mountable ends 104 and 105 are generally U-shaped and formed of conduit. The opposed legs 106 are formed of straight sections of conduit of a size slightly smaller than the conduit used to form the mountable ends 104 and 105 so that the opposed legs 106 may be slidingly received within the mountable ends 104 and 105 making the length of the rectangular frame 100 adjustable. The mountable ends 104 and 105 with the opposed legs 106 slidingly received therein define a rectangular open area 107.

Each mountable end 104 and 105 includes attachment means, such as attachment mechanism 118. Each attachment mechanism 118 comprises an elongate receiving arm engaging bar 119 having a length slightly smaller than the distance between opposed pairs of elongate receiving arms 80 on each rotatable mount 104 and 105. Each engaging bar 119 extends generally parallel to the respective mountable end 104 an 105 and is spaced away from the respective mountable end 104 and 105 by a spacer 120. A locking pin 121 is retained in each end of the engaging bar 119 and the locking pins 121 are biased outward by a spring 125 or the like. A retraction arm 122 extending perpendicular to each locking pin 121 extends through a pin retraction channel 123 in the engaging bar 119.

Figure 8:
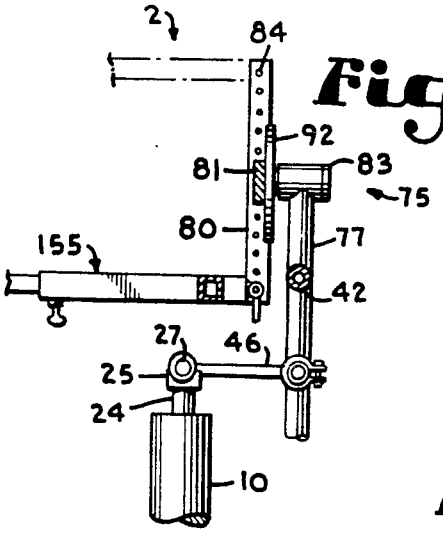
FIG. 8 is an enlarged and fragmentary cross-sectional view of the apparatus, taken along line 8—8 of FIG. 6
Figure 9:
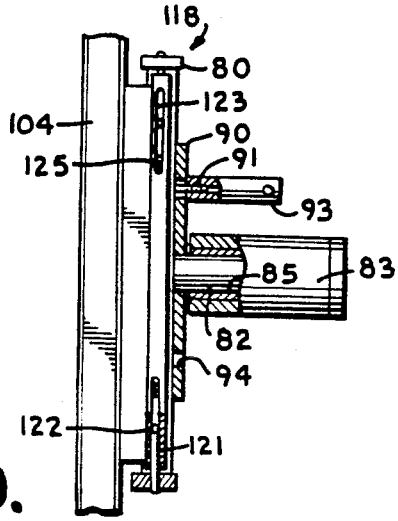
FIG. 9 is an enlarged and fragmentary view of a support mechanism of the apparatus for securing the patient support structure to a rotatable mount with portions broken away to show detail thereof.

When it is desired to attach the patient support structure 2 to the rotatable mounts 75 and 76, the locking pins are retracted using the retraction arms 122, the patient support structure 2 is then positioned so that the engaging bars 119 extend between the elongate receiving arms 80 (see FIG. 9), the retracted locking pins 121 are aligned with the desired pair of linearly aligned apertures 84 (see FIG. 8) in the receiving arms 80, and the retraction arms 122 are then released so that the locking pins 121 are spring biased into the apertures 84 and into locking engagement with the rotatable mounts 75 and 76.

It is foreseen that other means could be used to secure the patient support structure 2 to the rotatable mounts 7 and 76. For example, a rod could be inserted through aligned apertures 84 and a hollow engaging bar 119 aligned with the apertures 84.

Each support pad 101 is secured by a bracket 110 to a positioning sleeve 111. Each positioning sleeve 111 is slidingly secured to one of the opposed legs 106 of the rectangular frame 100 so that three support pads 101 are secured to each opposed leg 106. As shown in phantom lines in FIG. 13, the support pads 101 may be slidingly advanced along the opposed legs 106 and may be secured at a desired position by use of a set screw 112 extending through the underside of each positioning sleeve 111.

Each pair of support pads 101 extends partially across the rectangular open area 107 formed by the rectangular frame 100. The support pads 101 are angled downward and inward towards the rectangular open area 107, when a patient is supported thereby as in FIG. 4, thereby forming a V-shaped support surface for the patient. The dimensions of the rectangular frame 100 and the support pads 101 are such that the support pads 101 may be positioned so as to support a patient in a prone position on the support pads 101.

The patient support structure 2 further comprises a leg support means, such as support mechanism 127, and a pair of armrests 128. Each leg support mechanism 127 comprises a fabric sleeve 129 wrapped around a portion of the opposed legs 106 of the rectangular frame 100. The fabric sleeve 129 is positioned between the support pads 101 and the second mountable end 105 of the rectangular frame 100 so as to support the legs of a patient positioned on the support pads 101 in a prone position.

Each of the armrests 128, as shown in FIG. 14, comprise a flat, padded surface 130 adjustably connected to the opposed legs 106 of the rectangular frame 100. A first armrest sleeve 131 is slidingly secured to each of the opposed legs 106 between the support pads 101 and the first mountable end 104 of the rectangular frame 100. A first vertical armrest member 132 is secured to the first armrest sleeve 131 and extends vertically to the side of and below the opposed leg 106 to which it is secured, when supporting a patient. A second armrest sleeve 133 is secured to the end of the first vertical armrest member 132 and extends horizontally away from the rectangular frame 100. A horizontal armrest member 134 is slidingly received within the second armrest sleeve 133 and slidingly extends away from the rectangular frame 100. A third armrest sleeve 135 is secured in perpendicular alignment to the end of the horizontal member 134 extending away from the rectangular frame 100. A second vertical armrest member 136 is slidingly received within the third armrest sleeve 135. The upper end of the second vertical armrest member 136 is secured to the padded surface 130 in perpendicular alignment and the lower end of the second vertical armrest member 136 extends through the third armrest sleeve 135.

The position of the padded surface 130 may be adjusted by slidingly advancing the first vertical armrest member 132, the horizontal armrest member 134 and the second vertical armrest member 136 within the first, second and third armrest sleeves 131, 133 and 135. Armrest set screws 137 threaded through each of the armrest sleeves 131, 133 and 135 are selectively tightened to securè the padded surface 130 at a desired setting.

A planar support surface 155 having dimensions similar to those of the rectangular frame 100 is also removably securable to the rotatable mounts 75 and 76 by an attachment means such as attachment mechanism 156 similar in structure to the attachment mechanism 118 of the patient support structure 2.

When using the spinal surgery table 1, the horizontal support members 25 of the hydraulic lifts 10 and 11 are each initially positioned at their lowest position. The patient is placed in a supine position on the unattached planar support surface 155. The planar support surface 155, with the patient thereon, is then attached to elongate receiving arms 80 of the rotatable mounts 75 and 76 using the attachment means 156, as seen in FIG. 2.

The patient support structure 2 is then positioned over the patient so that the first and second mountable ends 104 and 105 are positioned with the engaging bars 119 of the first and second mountable ends 104 and 105 located between the elongate receiving arms 80 of the first and second rotatable mounts 75 and 76 respectively with the patient still supine, as seen in FIG. 3. The support pads 101 are positioned and secured in place by the set screws 112 so that one pair of support pads 101 engages the patient along the lateral aspects of the upper thoracic cage and the other pairs of support pads 101 engage the patient along the antero-lateral aspects of the pelvic girdle. The attachment mechanism 118 operates to secure the patient support structure 2 in such an engaging relationship with the patient.

After securing the patient support structure 2 to the rotatable mounts 75 and 76, the patient support structure 2, the planar support surface 155 and the patient are rotated 180 degrees about the axis extending through the pivot pins 82 of the rotatable mounts 75 and 76 so that the patient is supported in the prone position by the support pads of the patient support structure 2. The locking nut 93 of the position locking mechanism 90 is then selectively tightened to lock the patient support structure 2 in a desired position. Next, the planar support surface 155 is removed so as to expose the back of the patient, and the arms of the patient are positioned on the armrests 128 which are positionally adjusted to provide maximum comfort, as seen in FIG. 4. The upper portions of the elongate receiving arms 80 of the second rotatable mount 76 ma be pivoted downward (see left side in FIG. 4) to provide greater access for the surgical team to the patient.

The positioning of the patient on the support pads 101 as described above allows the patient's abdomen to hang pendulous and free which helps reduce bleeding during certain surgical procedures. The unobstructed open area 68 defined by the expandable framework 3 and the elongate base 4 provides easy access for various pieces of surgical equipment such as X-ray equipment. The design of the table 1 is particularly well adapted for use with a C-arm type X-ray unit to provide substantial intra-operative X-ray control. Opposite ends of the X-ray C-arm are readily positionable above and below the patient support structure 2 with the patient support structure 2 extending therebetween. The C-arm may also be rotated freely from side to side above and below the patient support structure 2 without interference.

Once the patient is positioned in the prone position on the patient support structure 2, the relative positioning of the patient may be adjusted using the hydraulic lifts 10 and 11 or the rotatable mounts 75 and 76 to pivotally swing the support structure 2 about the elongate axis thereof. To raise the head of the patient relative to the patient's feet, the hydraulic control unit 26 is operated to advance the horizontal support member 25 of the first hydraulic lift 10 to a desired height. As the horizontal support member 25 is advanced to a higher position, the expandable framework 3 pivots about the horizontal extension members 27 maintaining the end pieces 31 and 32 in generally perpendicular alignment with the cross member 34 and the pivot pins 82 of the rotatable mounts 75 and 76 in axial alignment. The expandable framework 3 and the patient support structure 2 expand to compensate for the increased distance between the end pieces 31 and 32 and the rotatable mounts 75 and 76.

The hydraulic control unit 26 may then be operated to lower the head of the patient relative to the patient's feet with the expandable framework 3 and the patient support surface contracting to compensate for the reduced distance between the end pieces 31 and 32 and the rotatable mounts 75 and 76. Similarly, the second hydraulic lift 11 may be operated to raise or lower the feet of the patient with respect to the head.

The back of the patient may be angled towards or away from the surgeon by loosening the locking nut 93 of the position locking mechanism 90 and rotating the patient support structure 2 and therefore the patient about the axis extending through the pivot pins 82 of the rotatable mounts 75 and 76. Once the back of the patient is positioned at the desired angle, the locking nut 93 may be tightened to secure the patient support structure 2 in position.

The ability to rotate the patient from side to side and the ability to use a C-arm type X-ray unit with the table 1, make the table 1 particularly well adapted for use in supporting a patient during back surgery, but the table i may also be used in other types of surgery requiring manipulation of a patient of this type, such as surgery to insert a pacemaker. The table 1 allows use of a C-arm X-ray to provide substantial fluoroscopic visualization of the heart during such surgery, and the ability to rotate the patient and therefore the patient's heart from side to side enhances the visualization and greatly facilitate the positioning of such a pacemaker.

It is to be understood that while certain forms of the present invention have been illustrated and described herein, it is not to be limited to the specific forms or arrangement of parts described and shown.

What is claimed and desired to be secured by Letters Patent is as follows:

1. An apparatus for use in supporting a patient during surgery comprising:

(a) an elongate base;

(b) an upright foot framework and an upright head framework with each of said frameworks movably connected to said base respectively near opposite ends of said base;

(c) first and second framework positioning means operably connecting said foot and head frameworks respectively to said base and operable to independently and selectively position said foot framework and said head framework between respective high and low positions thereof with respect to said base;

(d) first and second rotatable mounts pivotally connecting said first and second framework positioning means to said foot and head frameworks respectively; said first and second mounts being rotatable about first and second axes; said first and second axes being generally parallel to one another and spaced; said first and second mounts allowing said foot and head frameworks to raise the lower relative to each other;

(e) third and fourth rotatable mounts positioned on upper ends of said foot and head frameworks respectively; said third and fourth mounts allowing rotation about a generally coaxial third axis extending between said foot and head frameworks and generally perpendicular to said first and second axes of rotation; and (f) a patient support frame having patient support means mounted therealong; said frame being removably attachable to said third and fourth rotatable mounts such that opposed sides of said frame generally extend parallel to said third axis of rotation in spaced relation to and on opposite sides of said third axis of rotation, such that said support structure is rotatable at least 180 degrees about said third axis of rotation.

2. The apparatus according to claim 1 including (a) a cross-member operably connected to said head and foot frameworks and spaced below said patient support means so as to form a flexible four-sided structure; and (b) expansion means associated with said cross-member to automatically adjust for variance in length of said cross-member during raising and lowering of said frameworks relative to each other so as to maintain said frameworks in spaced and generally parallel relationship to one another.

3. The apparatus according to claim 2 wherein:

(a) said expansion means includes a telescoping section within said cross-member.

4. The apparatus according to claim 3 wherein:

(a) said expansion means further includes a second telescoping section within said patient support means.

5. The apparatus as described in claim 1 wherein:

(a) said frame includes a pair of opposed legs extending in parallel and spaced relation from said foot end to said head end; and (b) said support pads include at least two pairs of opposingly aligned pads slidably mounted on said opposed legs.

6. The apparatus as described in claim 1 wherein:

(a) said apparatus includes support motive means to allow said apparatus to be portable.

7. The apparatus as described in claim 1 including:

(a) a pair of adjustable arm rests; said arm rests being slidably mounted on opposed legs of said frame for positioning under and providing support for the arms of a patient supported by said pads and rotating with the patient on said patient support structure.

8. The apparatus as described in claim 1 including:

(a) a leg support structure positioned on said frame so as to provide support for the legs of a patient supported by said pads.

9. An apparatus for use in supporting a patient during surgery comprising:

(a) a patient support structure having an upright head framework, an upright foot framework, a cross-member connecting said head and foot frameworks and a patient support frame vertically spaced above said cross-member and extending generally between said head and foot framework;

(b) said patient support frame including support means therealong adapted to directly support the patient;

(c) framework positioning means for operably independently raising and lowering said head and foot frameworks relative to one another;

(d) pivot means to allow said patient support frame to pivot with respect to said head and foot frameworks upon raising and lowering of said frameworks; and (e) expansion means associated with said cross-member; said expansion means automatically adjusting the length of said cross-member so that said foot and head frameworks in generally parallel and spaced relationship relative to one another during raising and lowering thereof.

10. The apparatus according to claim 9 including:

(a) rotating means for operably supporting said patient support frame relative to said head and foot frameworks;

(b) said rotating means being rotatable about a first axis generally perpendicular to second and third axes associated with said pivot means; and (c) said rotating means allowing 360 degrees rotation of said patient support frame about said first axis.

11. The apparatus according to claim 9 wherein:

(a) said expansion means comprises a telescoping section of said cross-member.

12. The apparatus according to claim 9 wherein:

(a) said expansion means comprises a telescoping section of said patient support frame.

13. The apparatus as described in claim 9 including:

(a) a planar member having a support surface removably attachable to first and second rotatable mounts connected to said head and foot frameworks respectively and having a first position adapted to support a patient in a supine position; said patient support frame being selectively positionable opposite said support surface for receiving a patient in a supine position therebetween; and (b) said patient support frame being selectively rotatable about said rotatable mounts to a second position for location over a patient with said support frame beneath the patient.

14. The apparatus a described in claim 9 including:

(a) support pads comprising at least two pairs of opposingly aligned pads slidably mounted on opposed sides of said frame.

15. The apparatus as described in claim 9 including:

(a) a pair of arm rests slidably mounted on opposed sides of said frame for positioning under and providing support for the arms of a patient supported by said pads.

16. The apparatus as described in claim 9 including:

(a) a leg support structure positioned on said frame so as to support a patient's legs when the patient is supported in a prone position on said frame.

17. The apparatus as described in claim 9 wherein:
(a) said apparatus includes motive means to allow said apparatus to be portable.

18. The apparatus as described in claim 17 wherein:
(a) said motive means includes at least three wheels secured to an underside of said base allowing movement of said apparatus across a generally planar surface.

19. An apparatus for use in supporting a patient during surgery comprising:
(a) an elongate base having a head end and a foot end;
(b) at least three wheels secured to an underside of said base for movement of said apparatus across a generally planar surface;
(c) a first hydraulic lift and a second hydraulic lift secured to said head end and said foot end of said base respectively; each of said hydraulic lifts having a lift arm selectively extendable between a high and a low vertical position thereof;
(d) means for advancing said lift arms between said high and said low positions;
(e) a first support arm and a second support arm secured to and extending perpendicular to said lift arms of said first and second hydraulic lifts respectively such that said first and second support arms generally extend along and ar spaced above said head end and said foot end of said base respectively;
(f) an expandable framework comprising:
(1) a first and a second upright member each having an upper end and a lower end, said first and second upright members maintained in spaced and parallel relation;
(2) a cross member connected to and extending between said first and second upright members generally in perpendicular alignment at said lower ends thereof;
(3) first expansion means allowing said cross member to expand and retract between said first and second upright members so as to increase the distance therebetween while maintaining said first and second upright members in generally parallel relation;
(4) said first and second upright members pivotally secured to said first and second support arms respectively such that as said lift arms of said first and second hydraulic lifts are advanced between said high and low vertical positions said upper ends of said first and second upright members similarly advance between separate high and low positions such that when said lift arms are advanced independently said first and second upright members remain in generally parallel relation with respect to each other and in perpendicular alignment with respect to said cross member, and said first expansion means operates to increase or decrease the distance between said first and second upright members;
(g) a first rotatable mount and a second rotatable mount secured to said upper ends of said first and second upright members respectively; said rotatable mounts being inwardly directed and rotatable about an axis extending therebetween;
(h) a patient support structure having a first end and a second end and a pair of opposed legs extending between said first and second ends in spaced relation so as to define an opening therebetween;
(i) at least two pairs of opposingly aligned support pads selectively positionable on said opposed legs of said patient support structure for receiving a patient in a prone position, such that a patient extends from head to toe from said first end to said second end of said patient support structure respectively;
(j) said first end and said second end of said patient support structure selectively securable to said first and second rotatable mounts respectively such that said patient support structure extends between said first and second rotatable mounts and the axis of rotation of said rotatable mounts is adapted to generally extend through a patient supported in a prone position on said support pads when said patient support structure is secured to said rotatable mounts; said patient support structure includes a second expansion means allowing said patient support structure to expand and retract between said first and said second rotatable mounts to correspond with the expansion and retraction of said cross member when said patient support structure is secured to said rotatable mounts; and
(k) a planar support surface removably attachable to said first and second rotatable mounts such that said planar support surface is adapted to receive a patient thereon in a supine position; said patient support structure subsequently positionable so as to be adapted to be located over said patient; said planar support surface and said patient support structure subsequently rotatable about the axis of rotation of said rotatable mounts so as to be adapted to rotate the patient so that the patient is then supported in a prone position by said support pads; said planar support surface subsequently removable from said rotatable mounts.

20. The apparatus as described in claim 14 including:
(a) a pair of adjustable armrests; said armrests selectively positionable on said opposed legs of said patient support structure for positioning under and providing support for the arms of a patient supported by said pads.

21. The apparatus as described in claim 14 including:
(a) a leg support structure positioned on said patient support structure for supporting a patient's legs when the patient is supported in a prone position on said structure.

* * * * *